US008727076B2

(12) United States Patent
Lee

(10) Patent No.: US 8,727,076 B2
(45) Date of Patent: May 20, 2014

(54) DEVICE FOR DRIVING A DOOR OF AN ELEVATOR

(75) Inventor: Jin Koo Lee, Gyeonggido (KR)

(73) Assignee: Otis Elevator Company, Farmington, CT (US)

( * ) Notice: Subject to any disclaimer, the term of this patent is extended or adjusted under 35 U.S.C. 154(b) by 363 days.

(21) Appl. No.: 12/672,668

(22) PCT Filed: Jul. 31, 2008

(86) PCT No.: PCT/US2008/071759

§ 371 (c)(1),
(2), (4) Date: Feb. 8, 2010

(87) PCT Pub. No.: WO2009/029380

PCT Pub. Date: Mar. 5, 2009

(65) Prior Publication Data

US 2011/0198158 A1 Aug. 18, 2011

(30) Foreign Application Priority Data

Aug. 30, 2007 (KR) ..... 10-2007-0087441

(51) Int. Cl.
*B66B 13/06* (2006.01)
*E05C 7/06* (2006.01)

(52) U.S. Cl.
USPC ..... 187/324; 49/120

(58) Field of Classification Search
USPC ..... 187/318, 324, 334; 49/118, 120, 123, 49/370, 358, 360; 310/67 R, 268
IPC ..... B66B 13/06,13/12
See application file for complete search history.

(56) References Cited

U.S. PATENT DOCUMENTS 3,746,902 A * 7/1973 Hetzel ..... 310/67 R
4,701,653 A * 10/1987 Merkle et al. ..... 310/152
4,724,346 A * 2/1988 Klein et al. ..... 310/67 R
5,469,937 A 11/1995 Hakala et al.

(Continued)

FOREIGN PATENT DOCUMENTS

CN 1105336 A 7/1995
CN 1331655 A 1/2002

(Continued)

OTHER PUBLICATIONS

JP2007153495A English Translation.pdf.*

(Continued)

*Primary Examiner* — William E Dondero
*Assistant Examiner* — Minh Truong
(74) *Attorney, Agent, or Firm* — Cantor Colburn LLP

(57) ABSTRACT

A device for driving a door of an elevator includes a door header, a door, and a driving motor. The door header, which is mounted on a frame defining a doorway, includes a vertical portion substantially parallel to a plane of the doorway. The door is movably supported on the frame. The driving motor, which is disposed on the vertical portion of the door header, includes a housing fixed with respect to the vertical portion, a rotating shaft having an axis that is oriented substantially perpendicularly to the vertical portion, a driving pulley, and a driving portion. The rotating shaft is rotatably supported by the vertical portion at one end thereof and is rotatably supported by the housing at the other end thereof. The driving pulley is coupled to the rotating shaft. The driving portion drives the rotating shaft.

18 Claims, 8 Drawing Sheets

(56) References Cited

U.S. PATENT DOCUMENTS

| | | | | | |
|---|---|---|---|---|---|
| 5,678,660 | A | * | 10/1997 | Karner et al. | 187/333 |
| 5,711,112 | A | * | 1/1998 | Barten et al. | 49/118 |
| 5,756,946 | A | | 5/1998 | Tracey et al. | |
| 5,841,082 | A | | 11/1998 | Rivera et al. | |
| 5,852,897 | A | | 12/1998 | Sukale | |
| 5,864,443 | A | | 1/1999 | Elsaesser et al. | |
| 5,878,846 | A | | 3/1999 | O'Donnell | |
| RE37,058 | E | * | 2/2001 | Elsasser et al. | 360/98.07 |
| 6,595,889 | B2 | * | 7/2003 | Minegishi et al. | 475/183 |
| 7,202,615 | B2 | | 4/2007 | Morris et al. | |
| 7,246,688 | B2 | | 7/2007 | Tonna et al. | |
| 2004/0256181 | A1 | | 12/2004 | Durand et al. | |

FOREIGN PATENT DOCUMENTS

| | | | |
|---|---|---|---|
| EP | 1396461 | | 3/2004 |
| JP | 2001-226058 | A | 8/2001 |
| JP | 2004001982 | | 1/2004 |
| JP | 2004-338850 | A | 12/2004 |
| JP | 2007-153495 | A | 6/2007 |
| JP | 2007153495 | A | 6/2007 |
| JP | 2007153495 | A | 6/2007 |
| WO | 03029124 | | 4/2003 |
| WO | 03029124 | A1 | 4/2003 |
| WO | WO03/029124 | | 4/2003 |
| WO | 2006027411 | | 3/2006 |
| WO | 2008071759 | A1 | 6/2008 |
| WO | 2009029380 | A1 | 3/2009 |

OTHER PUBLICATIONS

JP20041982 English Translation.pdf.*

International Search Report & Written Opinion PCT/US2008/071759 Dated Nov. 18, 2008—8 pages.

The English translation of the 2nd Russian Office Action dated Oct. 2, 2012 for Russian Patent Application No. 2010112457.

The English translation of the Office Action dated May 9, 2012 for Japanese Patent Application No. 2010-523011.

The Jun. 25, 2012 First Office Action translation from China.

The Jul. 31, 2012 Final Office Action translation from Korea.

State Intellectual Property Office, P.R. China, Second Office Action, Jan. 14, 2013, 8 pages.

English Translation of Chinese Office Action, issued Jun. 13, 2013.

English Translation of Chinese Search Report, mailed May 29, 2013.

* cited by examiner

DEVICE FOR DRIVING A DOOR OF AN ELEVATOR

CROSS-REFERENCE TO RELATED APPLICATIONS

This application claims priority to, and hereby incorporates by reference in its entirety, Korean Priority Application No. 10-2007-0087441, which was filed on Aug. 30, 2007.

Additionally reference is made to PCT Application No. PCT/US2008/71759filed Jul. 31, 2008, entitled "DEVICE FOR DRIVING A DOOR OF AN ELEVATOR"and is assigned to the same assignee as this application.

BACKGROUND

FIG. 1 is a front elevation view illustrating a conventional elevator car, and FIG. 2 is a side view showing the car door apparatus in FIG. 1, with car body 1 being shown in cross-section. As illustrated, elevator car entrance 2 is provided at the front face of car body 1. Door frame 3 extends along the width of entrance 2, and is fixed to car body 1 above entrance 2. Door motor 4 having motor pulley 5 is mounted on door frame 3. Reduction pulley 6 having a larger diameter than motor pulley 5 has belt 7 wound between motor pulley 5 and reduction pulley 6. Drive pulley 8 has a smaller diameter than and is coaxial with reduction pulley 6, can be rotated integrally with the reduction pulley 6. Following pulley 9 is provided at the door frame 3, with second belt 10 wound between drive pulley 8 and following pulley 9.

Door rail 11 extends along the width direction of entrance 2 and is attached to door frame 3. Two car doors 12 are suspended from door rail 11 through door hangers 13. Each door hanger 13 has two rollers 14 which are rotated along door rail 11. Car doors 12 are connected to second belt 10 through door hanger 13 and belt holders 15 and 16. A plurality of door shoes 17 are attached adjacent the lower edge of each of doors 12. Door shoes 17 are inserted into a groove (not shown) of sill 18 disposed at the lower portion of entrance 2. Further, car body 1 is provided with upper panel 19 and ceiling panel 20.

During operation, motor pulley 5 is rotated by door motor 4, and the rotation is transmitted to reduction pulley 6 through reduction belt 7. Drive pulley 8 is rotated with reduction pulley 6, and thus second belt 10 is circulated and following pulley 9 is rotated.

Since door hangers 13 are connected to belt 10, door hangers 13 and doors 12 are reciprocated along door rail 11 by the circulation of second belt 10 to open or close entrance 2. Doors 12 are suspended from door rail 11 and the bottom portions of doors 12 are guided by the sill groove of sill 18 during the opening and the closing of doors 12.

FIGS. 1 and 2 show a prior art device for driving a door of an elevator car, wherein door motor 4 is located above car body 1 and ceiling plate 20 of car body 1 is placed just below door motor 4. When designing the elevator car with higher ceiling plate 20, which is equipped with such a door driving device, ceiling plate 20 cannot help but interfere with door motor 4. Accordingly, the door driving device must be redesigned in order to avoid such interference. Further, large noise may occur in such a door driving device due to reduction pulley 6 and reduction belt 7 during the movement of doors 12.

FIGS. 3 and 4 show another prior art device for driving doors 2 of elevator car 1, wherein door motor 22 is disposed under horizontal portion 21*b* of a door frame 21 inside plane A extending parallel to vertical end face 18*b* of a sill, thereby eliminating interference between door motor 22 and ceiling plate 20. In this embodiment, bolts 23 hold door motor 22 in place on horizontal portion 21*b* of door frame 21, while vertical portion 21*a* extends down to attach to rail 11. Driving pulley 24 is attached to drive motor 22, and connected to following pulley 25 via belt 26. Rail 11 extends along the width of car 1, with door hangers 13 and corresponding rollers 14 being supported thereon. Doors 12 are connected to belt 26 through door hangers 13 and belt holders 15 and 16. Door shoes 17 are attached adjacent lower edge of doors 12, and are inserted into groove 18*a* of sill 18. The door operates as described before, with the exception being that drive motor is connected directly to driving pulley 24 without a reduction mechanism.

However, since a driving shaft of door motor 22 is not directly supported by door frame 21, vibrations caused by the rotation of the driving shaft can be applied to door frame 21 during operation of door motor 22. Further, since the distal end of the driving shaft, to which driving pulley 24 is coupled, serves as a free end, the load applied to driving pulley 24 through belt 26 during movement of doors 12 cannot be smoothly supported, thereby causing vibrations and noise.

Accordingly, a driving motor, which is configured to cause less vibration and noise, is necessary for driving a door of an elevator. Further, a device for driving a door of an elevator that does not interfere with a ceiling plate of an elevator and is compactly configured is needed.

In light of the foregoing, the present invention aims to resolve one or more of the aforementioned issues that afflict elevator systems.

SUMMARY

An embodiment of the present invention is directed to a device for driving a door of an elevator, which device includes a door header, a door, and a driving motor. The door header, which is mounted on a frame defining a doorway, includes a vertical portion substantially parallel to a plane of the doorway. The door is movably supported on the frame. The driving motor, which is disposed on the vertical portion of the door header, includes a housing fixed with respect to the vertical portion, a rotating shaft having an axis that is oriented substantially perpendicularly to the vertical portion, a driving pulley, and a driving portion. The rotating shaft is rotatably supported by the vertical portion at one end thereof and is rotatably supported by the housing at the other end thereof. The driving pulley is coupled to the rotating shaft. The driving portion drives the rotating shaft.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
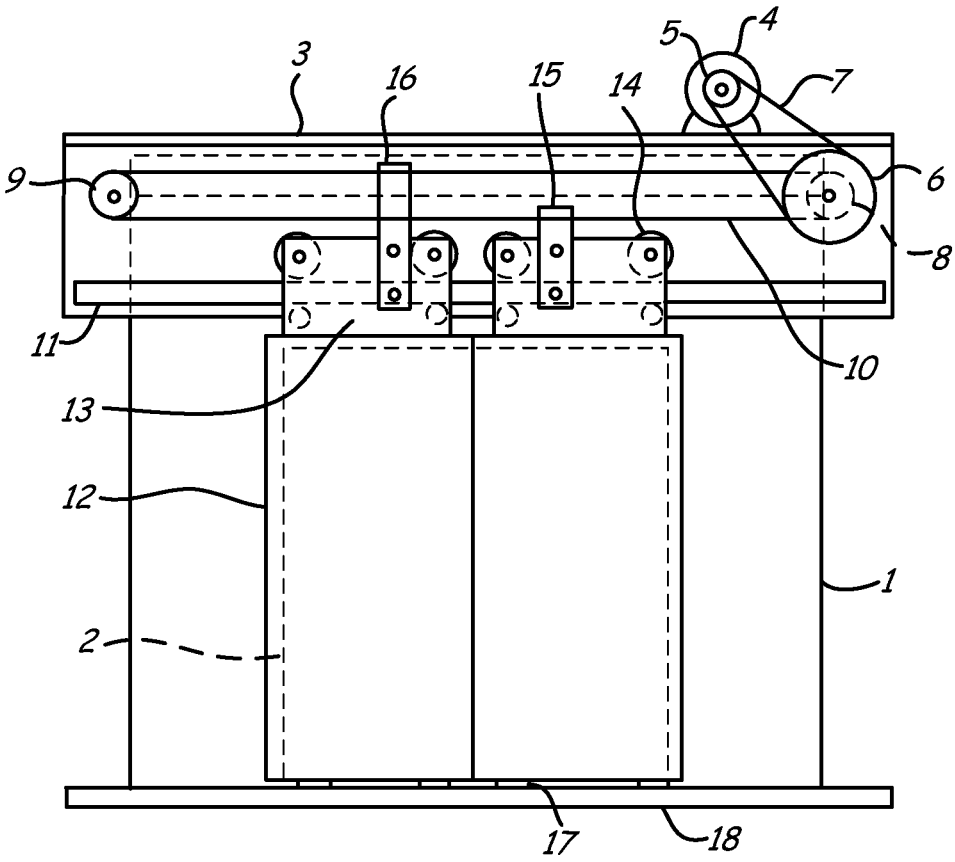
Fig. 1 PRIOR ART
FIG. 1 is a front elevation view of a sliding elevator door known in the prior art.
Figure 2:
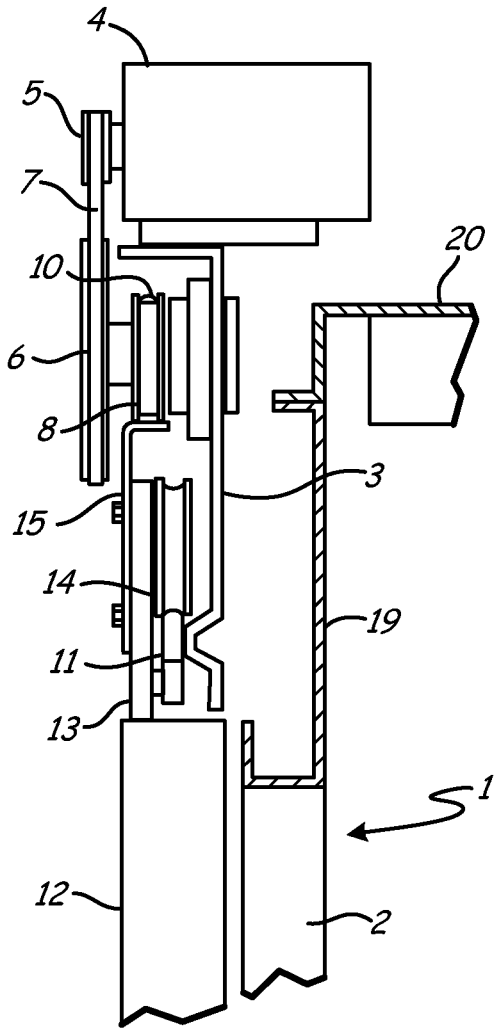
Fig. 2 PRIOR ART
FIG. 2 is a side elevation view of a portion of the door shown in FIG. 1.
Figure 3:
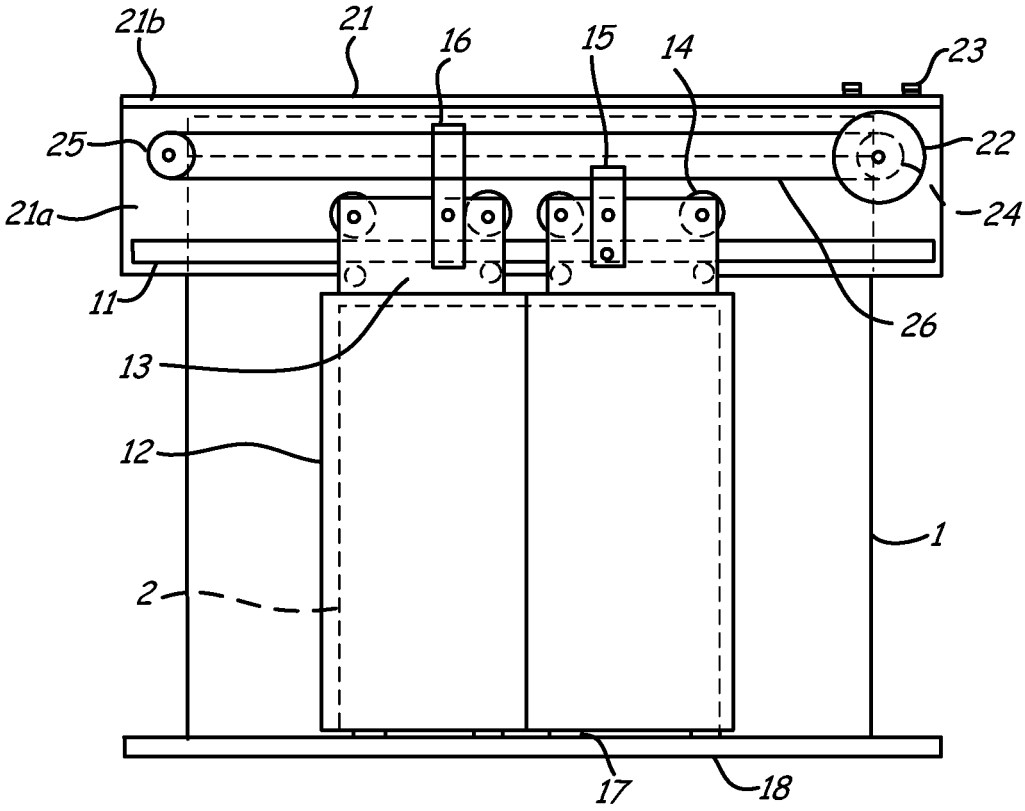
Fig. 3 PRIOR ART
FIG. 3 is a front elevation view of a different embodiment of a sliding elevator door known in the prior art.
Figure 4:
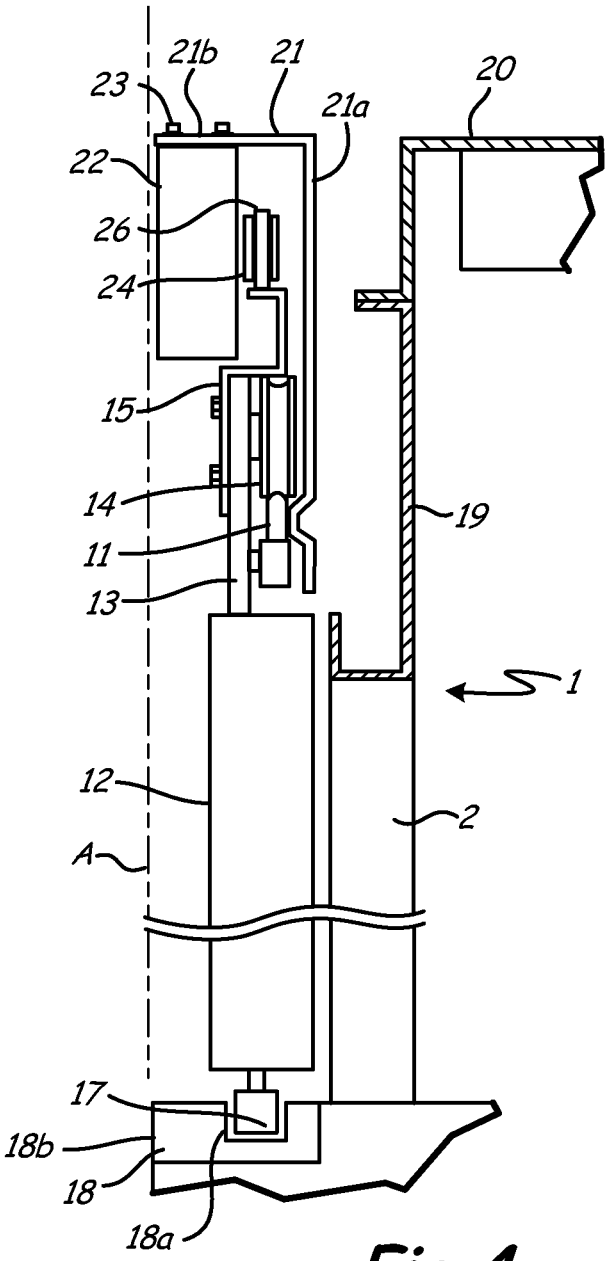
Fig. 4 PRIOR ART
FIG. 4 is a side elevation view of a portion of the door shown in FIG. 3.

Efforts have been made throughout the drawings to use the same or similar reference numerals for the same or like components.

Figure 5:
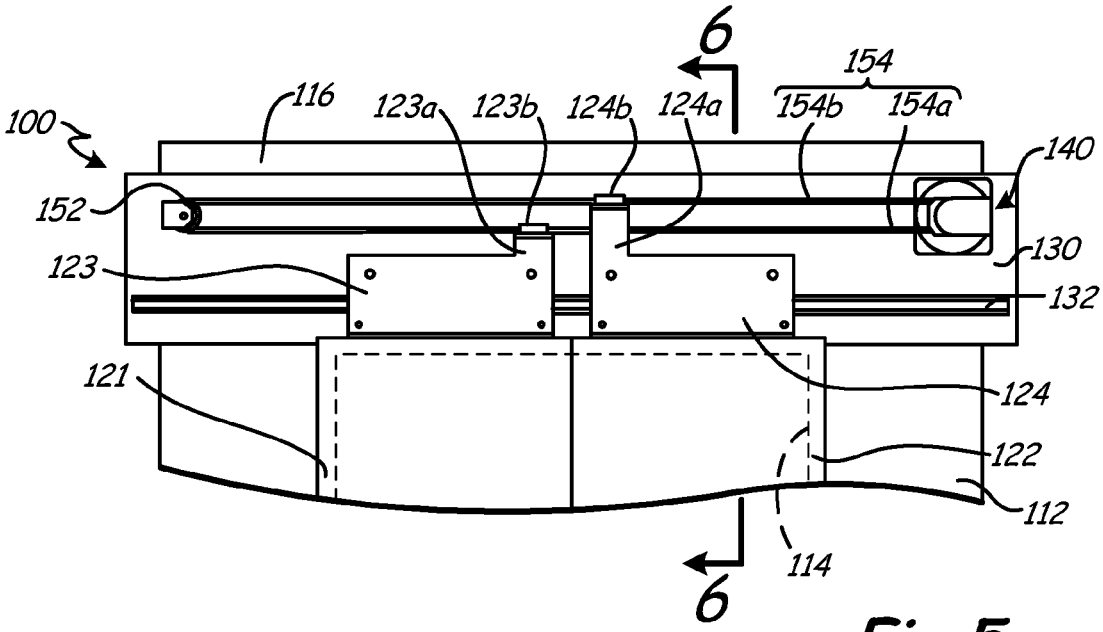
FIG. 5 is a front elevation view of a portion of an embodiment of an elevator car according to the present invention.
Figure 6:
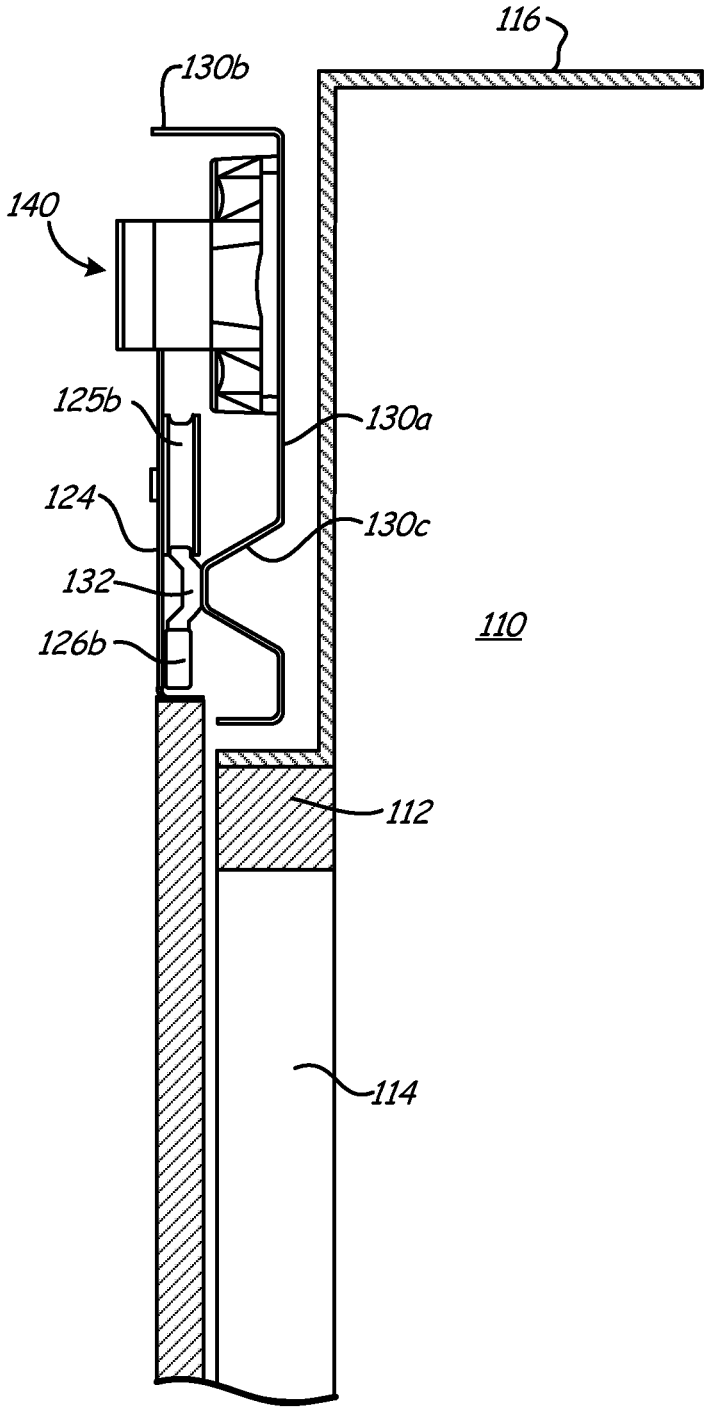
FIG. 6 is a cross-sectional view of a portion of the door shown in FIG. 5.

FIG. 5 is a front elevation view of a portion of an embodiment of an elevator car. FIG. 6 is a cross-sectional view of a portion of the car shown in FIG. 5. Illustrated in FIGS. 5 and 6 are elevator door driving device 100, elevator car 110, frame 112, doorway 114, ceiling plate 116, doors 121 and 122, door hangers 123 and 124 having upper portions 123*a* and 124*a* and belt holders 123*b* and 124*b*, upper roller 125*b*, lower roller 126*b*, door header 130 with vertical portion 130*a*, horizontal portion 130*b*, and bent section 130*c*, rail 132, driving motor 140, driven pulley 152, and belt 154 having lower portion 154*a* and upper portion 154*b*.

As shown in FIGS. 5 and 6, elevator door driving device 100 is configured to be disposed at elevator car 110 to drive doors 121 and 122. Elevator door driving device 100 has door header 130 mounted above doorway 114 of elevator car 110; door rail 132 provided on door header 130 for supporting upper sides of doors 121 and 122; driving motor 140 disposed on door header 130 above door rail 132 and having driving pulley (not shown) therein; driven (or following or idler) pulley 152 rotatably provided on door header 130 as being apart from driving pulley; and drive belt 154 wound around driving pulley and driven pulley 152 along a lengthwise direction of door header 130. Drive belt 154 is a continuous piece of material, such as a rubber strap or rope.

Doors 121 and 122 each contain door hanger 123 and 124, respectively, which attach doors 121 and 122 to drive belt 154. Upper portion 123*a* of door hanger 123 contains belt holder 123*b* for attaching to lower portion 154*a* of drive belt 154, and upper portion 124*a* of door hanger 124 contains belt holder 124*b* for attaching to upper portion 154*b* of drive belt 154. Belt holders 123*b* and 124*b* are pulleys, sheaves, or similar wheels with a slot or similar surface for receiving drive belt 154, and may be constructed from metal, polymers, or similarly rigid materials. Door hanger 124 also has upper roller 125*b* and lower roller 126*b* that engage rail 132 to provide smooth motion for the operation of door 122. Rollers 125*b* and 126*b* are wheels or similarly round structures with a surface for engaging rail 132, and may be constructed from metal, polymers, resilient material, or any combination thereof. In the embodiment illustrated, upper roller 125*b* is a pulley or sheave with outer lips that extend past the engagement surface of rail 132, while lower roller 126*b* is a wheel having a rim covered by a resilient material to engage rail 132 to dampen vibrations and other resultant forces during operation of door 122. Door hanger 123 contains similar corresponding structures.

Elevator car 110 includes frame 112 defining doorway 114. A portion of ceiling plate 116 is attached to an upper side of frame 112. Door header 130 includes vertical portion 130*a* substantially parallel to doorway 114, and horizontal portion 130*b* extending from an upper end of vertical portion 130*a*. Horizontal portion 130*b* may be omitted. Driving motor 140 is mounted on vertical portion 130*a* of door header 130 above door rail 132. Door header may contain bent section 130*c* that secures and spaces the position of door rail 132 with respect to driving motor 140.

Figure 7:
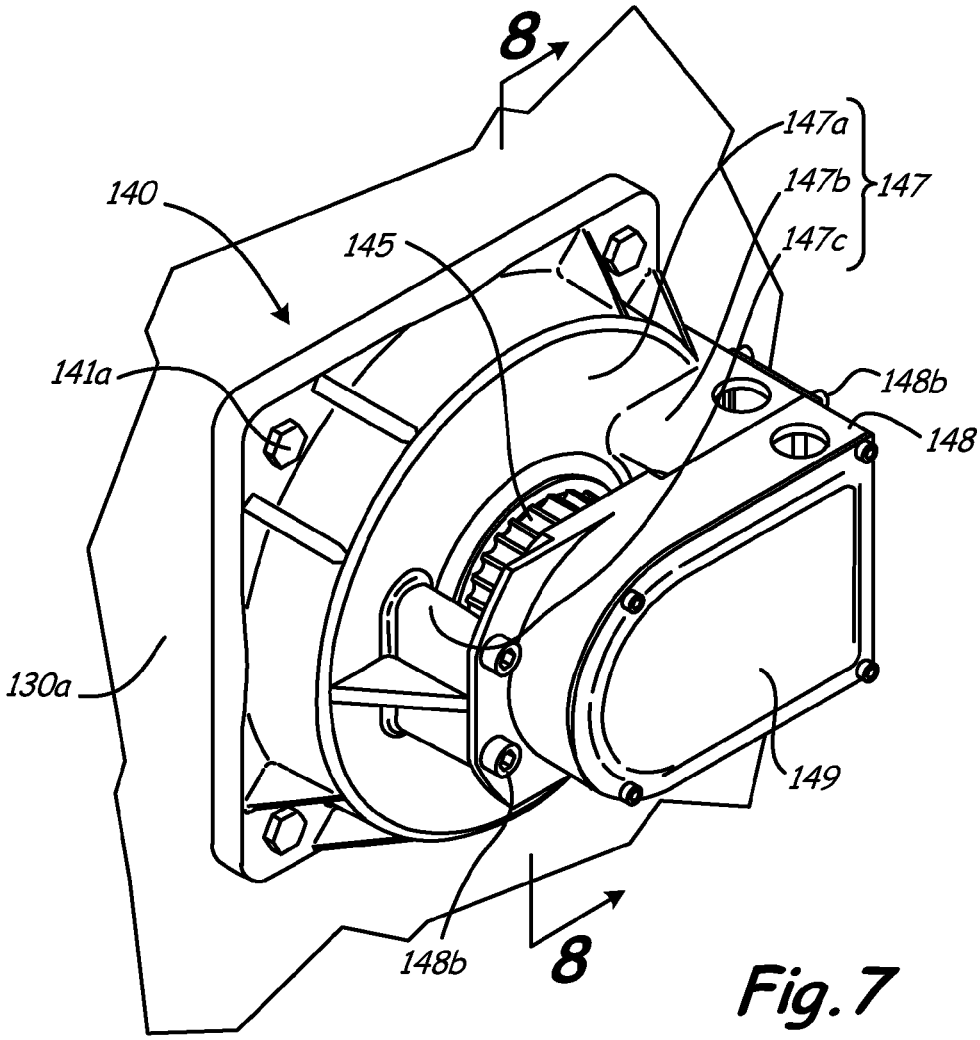
FIG. 7 is a perspective view of an embodiment of a motor for driving an elevator door according to the present invention.
Figure 8:
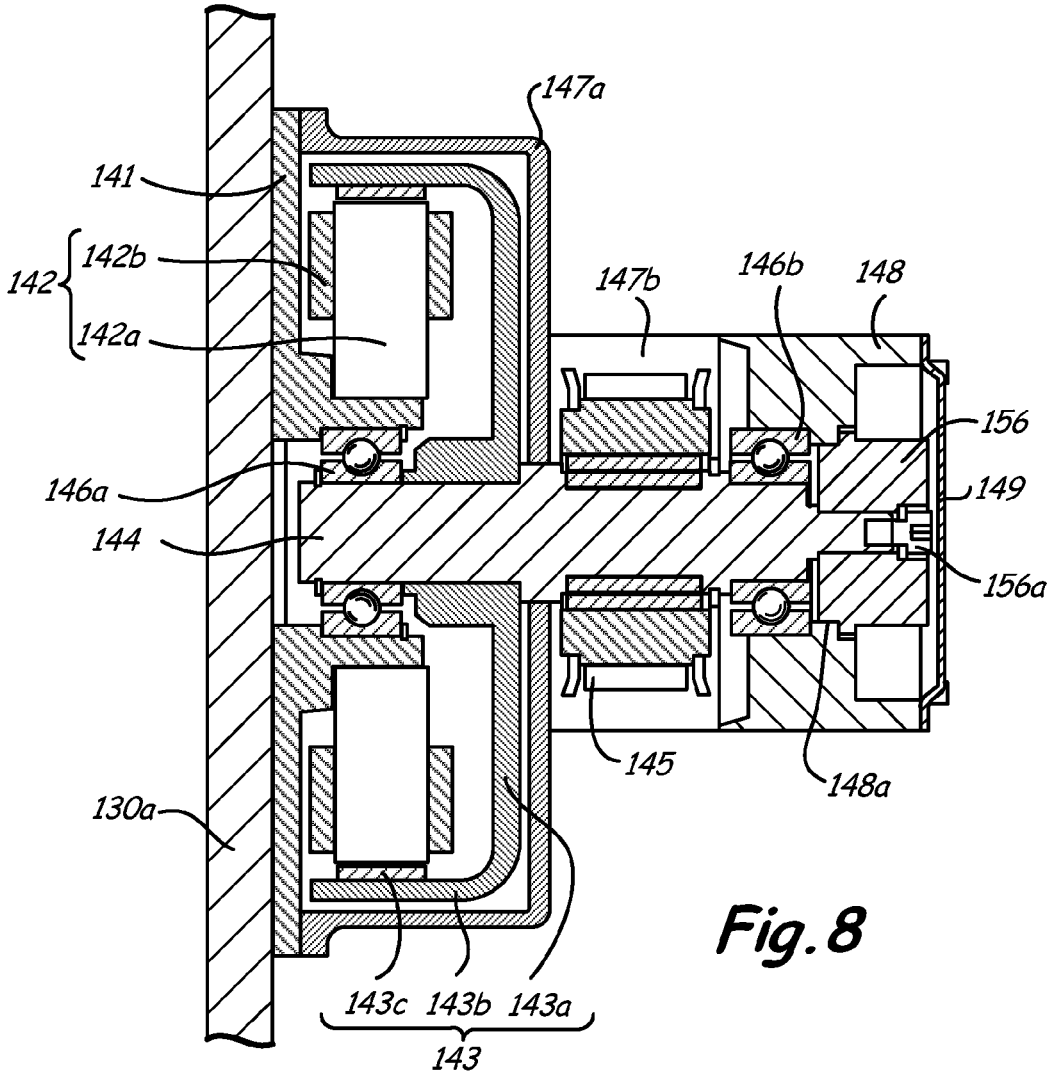
FIG. 8 is a cross-sectional view of the motor illustrated in FIG. 7.

FIG. 7 is a perspective view of an embodiment of a motor for driving an elevator door, and FIG. 8 is a cross-sectional view of the motor illustrated in FIG. 7. Illustrated in FIGS. 7 and 8 are vertical portion 130*a*, driving motor 140, cover 141, fastener 141*a*, stator portion 142 with core 142*a* and coil 142*b*, rotor portion 143 with disk portion 143*a*, rim portion 143*b*, and magnet 143*c*, rotating shaft 144, driving pulley 145, bearings 146*a* and 146*b*, first housing 147 with rotor cover 147*a*, inner connection 147*b*, and outer connection 147*c*, second housing 148 with inner portion 148*a*, fasteners 148*b*, cover plate 149, and transducer 156 with rotor 156*a*.

FIGS. 7 and 8 show driving motor 140, which has first and second housings 147 and 148 fixed with respect to vertical portion 130*a*; rotating shaft 144 oriented perpendicularly to vertical portion 130*a* and being rotatably supported at both its ends; driving pulley 145 coupled to rotating shaft 144; and a driving portion formed of stator 142 and rotor portion 143 for driving rotating shaft 144. Cover 141 is provided between vertical portion 130*a* and first housing 147, and is secured to vertical portion 130*a* via fasteners such as 141*a*. First housing 147 contains rotor cover 147*a*, inner connection 147*b* and outer connection 147*c*. Second housing 148 is attached to inner connection 147*b* and outer connection 147*c* through fasteners 148*b*, which may be machine screws, bolts, or similar structures. Second housing 148 may contain cover plate 149 that is generally parallel to cover 141. Cover plate 149, first and second housings 147, 148, and cover 141 may be constructed from sheet metal, cast alloys or metals, or polymers. Also attached to shaft 144 is transducer 156, which may be either an encoder or resolver, secured by inner portion 148*a* of second housing 148. In the embodiment illustrated, transducer 156 is a resolver with rotor 156*a* surrounded by stator windings.

The driving portion has stator portion 142 radially disposed about rotating shaft 144 and rotor portion 143 relatively rotated with respect to stator portion 142 by a magnetic force. Stator portion 142 includes a plurality of cores 142*a* and coils 142*b* wound around respective cores 142*a*. Rotor portion 143 includes: disk portion 143*a* with a central hole; rim portion 143*b* extending from an edge of disk portion 143*a*; and a plurality of magnets 143*c* attached on an inner periphery of rim portion 143*b*. First housing 147 is fixed to vertical portion 130*a* via the cover 141 while surrounding stator portion 142 and rotor portion 143. Second housing 148 is fixed to first housing 147 with driving pulley 145 interposed therebetween. Driving motor 140 further has first bearing 146*a* fixed to cover 141, and second bearing 146*b* disposed at second housing 148. One end portion and the other end portion of rotating shaft 144 are fitted to first bearing 146*a* and second bearing 146*b*, respectively.

Since driving motor 140 is disposed on vertical portion 130*a* of door header 130, door header 130 becomes small in terms of height and an unnecessary space to be induced by driving motor 140 can be eliminated. Thus, elevator door driving device 100 can be easily applied without any redesign thereof even when designing an elevator car with higher ceiling plate 116.

Further, since the one end of rotating shaft 144 is fitted to first bearing 146*a*, which is supported with respect to vertical portion 130*a* via cover 141, vertical portion 130*a* can directly support rotating shaft 144. Therefore, driving motor 140 can be more stably operated while making less vibration. Further, since rotating shaft 144 is rotatably supported via first and second bearings 146*a*, 146*b* at both its ends, the load applied to driving pulley 145 during operation of elevator door driving device 100 can be more stably supported. Thus, vibration and noise occurring during movement of doors 121 and 122 can be remarkably reduced, thereby providing a faster driving of doors 121 and 122.

In addition, there is provided an integrated constitution, wherein rotor portion 143 and driving pulley 145 are coupled to rotating shaft 144 in a lengthwise direction thereof. Thus, the power output of driving motor 140 can be transmitted to driving pulley 145 without any loss and driving motor 140 can be configured more compactly. The orientation of rotor 143 having disk 143*a* located outside of bearing 146*a* instead of adjacent vertical portion 130*a* provides the advantage of further stability of motor 140. In contrast, prior art motors place the disk portion on the end of shaft 144, next to vertical portion 130*a* and inside of bearing 146; such a prior art arrangement produces more imbalance in the rotor due to the cantilevered positioning, as well as provides less protection for the motor from outside vibrations on header 130. Further, the current arrangement with cover plate 141 and first housing 147 provide better protection from foreign particles, such as dust or water, during assembly and operation of the motor compared to prior art designs.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. A device for driving a door of an elevator, comprising:
- a door header mounted on a frame defining a doorway, the door header including a vertical portion substantially parallel to a plane of the doorway;
- a door movably supported on the frame;
- a driving motor disposed on the vertical portion of the door header, the driving motor comprising:
  - a housing fixed with respect to the vertical portion;
  - a first bearing mounted proximate the vertical portion;
  - a second bearing mounted to the housing;
  - a rotating shaft having an axis that is oriented substantially perpendicularly to the vertical portion, the rotating shaft being rotatably supported by the first bearing at one end thereof and being rotatably supported by the second bearing at the other end thereof;
  - a driving pulley coupled to the rotating shaft; and
  - a driving portion for driving the rotating shaft, the driving portion comprising:
    - a stator portion supported by the vertical portion; and
    - a rotor portion comprising:
      - a disk portion with a central hole for reception of the rotating shaft; and
      - a rim portion extending from an edge of the disk portion;
    - wherein the vertical portion is located on a first side of the stator portion, and the disk portion is arranged on a second side of the stator portion with the rim portion extending towards the vertical portion and surrounding the stator portion circumferentially;
    - wherein the first bearing is located between the vertical portion and the disk portion;
    - wherein the disk portion is located between the first bearing and the second bearing; and
    - wherein the driving pulley is located between the disk portion and the second bearing.

2. The device of claim 1, further comprising:
- a driven pulley provided on the vertical portion apart from the driving pulley; and
- a driving belt wound around the driving pulley and the driven pulley, the door being attached to the driving belt.

3. The device of claim 1 wherein the rotor portion further comprises:
- a plurality of magnets attached on an inner periphery of the rim portion facing the stator portion.

4. The device of claim 1 wherein the driving motor further comprises:
- a transducer for relating a position of the rotating shaft.

5. The device of claim 4 wherein the transducer is a resolver containing a rotor section and a stator section.

6. The device of claim 5 wherein the resolver is contained within a second housing.

7. An elevator car comprising:
- at least one elevator door;
- a door header mounted on a frame defining a doorway for the at least one door, the door header including a vertical portion substantially parallel to a plane of the doorway, wherein the at least one door is movably supported on the frame;
- a driving motor disposed on the vertical portion of the door header, the driving motor comprising:
  - a housing fixed with respect to the vertical portion;
  - a first bearing mounted proximate the vertical portion;
  - a second bearing mounted to the housing;
  - a rotating shaft having an axis that is oriented substantially perpendicularly to the vertical portion, the rotating shaft being rotatably supported by the first bearing at one end thereof and being rotatably supported by the second bearing at the other end thereof;
  - a driving pulley coupled to the rotating shaft; and
  - a driving portion for driving the rotating shaft, the driving portion comprising:
    - a stator portion supported by the vertical portion; and
    - a rotor portion comprising:
      - a disk portion with a central hole for reception of the rotating shaft; and
      - a rim portion extending from an edge of the disk portion;
    - wherein the vertical portion is located on a first side of the stator portion, and the disk portion is arranged on a second side of the stator portion with the rim portion extending towards the vertical portion and surrounding the stator portion circumferentially;
    - wherein the first bearing is located between the vertical portion and the disk portion;
    - wherein the disk portion is located between the first bearing and the second bearing; and wherein the driving pulley is located between the disk portion and the second pulley.

8. The elevator car of claim 7 further comprising:

a driven pulley provided on the vertical portion apart from the driving pulley; and a driving belt wound around the driving pulley and the driven pulley, the at least one door being attached to the driving belt.

9. The elevator car of claim 7 wherein the rotor portion further comprises:

a plurality of magnets attached on an inner periphery of the rim portion facing the stator portion.

10. The elevator car of claim 7 wherein the driving motor further comprises:

a transducer for relating a position of the rotating shaft.

11. The elevator car of claim 10 wherein the transducer is a resolver containing a rotor section and a stator section.

12. The elevator car of claim 11 wherein the resolver is contained within the housing.

13. The elevator car of claim 7 further comprising:

a door rail provided on the vertical portion of the door header, wherein the at least one door is supported on the rail by an upper roller on a top side of the rail and a lower roller on a bottom side of the rail.

14. An elevator door driving apparatus for use in an elevator, the elevator including an elevator car having a header mounted on a frame defining a doorway with a door, the header having a door rail mounted on a vertical portion of the header substantially parallel to the plane of the doorway, with the door being movably connected to the rail, the apparatus comprising:

a driving motor disposed on the vertical portion of the door header, the driving motor comprising:

a motor cover secured to the vertical portion of the header;

a housing fixed with respect to the motor cover;

a first bearing mounted proximate the motor cover;

a second bearing mounted to the housing;

a rotating shaft having an axis that is oriented substantially perpendicularly to the vertical portion, the rotating shaft being rotatably supported by the first bearing at one end thereof and being rotatably supported by the second bearing at the other end thereof;

a driving pulley coupled to the rotating shaft; and a driving portion for driving the rotating shaft, the driving portion comprising:

a stator portion supported by the vertical portion; and a rotor portion comprising:

a disk portion with a central hole for reception of the rotating shaft; and a rim portion extending from an edge of the disk portion;

wherein the vertical portion is located on a first side of the stator portion, and the disk portion is arranged on a second side of the stator portion with the rim portion extending towards the vertical portion and surrounding the stator portion circumferentially;

wherein the first bearing is located between the vertical portion and the disk portion;

wherein the disk portion is located between a first bearing and a second bearing; and wherein the driving pulley is located between the disk portion ad the second bearing.

15. The apparatus of claim 14 further comprising:

a driven pulley provided on the vertical portion apart from the driving pulley; and a driving belt wound around the driving pulley and the driven pulley, the door being attached to the driving belt.

16. The apparatus of claim 14 wherein the rotor portion further comprises:

a plurality of magnets attached on an inner periphery of the rim portion facing the stator portion.

17. The apparatus of claim 14 wherein the shaft is rotatably supported by a bearing in contact with the motor cover.

18. The apparatus of claim 17 wherein the rotor is secured to the shaft adjacent the bearing.

* * * * *